US006547961B2

(12) United States Patent
Uto et al.

(10) Patent No.: US 6,547,961 B2
(45) Date of Patent: Apr. 15, 2003

(54) GRINDING SLURRY RECYCLING APPARATUS

(75) Inventors: Mitsuyoshi Uto, Tokyo (JP); Nobuki Kondo, deceased, late of Kanagawa (JP), by Ikuyo Kondo, executor

(73) Assignees: NEC Electronics Corporation, Kanagawa (JP); Toyoko Kagaku Co., Ltd., Kanagawa (JP)

( * ) Notice: Subject to any disclaimer, the term of this patent is extended or adjusted under 35 U.S.C. 154(b) by 0 days.

(21) Appl. No.: 09/825,935

(22) Filed: Apr. 5, 2001

(65) Prior Publication Data

US 2002/0014448 A1 Feb. 7, 2002

(30) Foreign Application Priority Data

Apr. 6, 2000 (JP) ..... 2000-104806

(51) Int. Cl.[7] ..... B01D 21/26; B24B 57/02

(52) U.S. Cl. ..... 210/167; 210/194; 210/195.1; 210/243; 210/252; 210/512.1; 210/512.2; 210/748

(58) Field of Search ..... 210/167, 194, 210/195.1, 243, 252, 512.1, 512.2, 788, 805, 748; 366/127

(56) References Cited

U.S. PATENT DOCUMENTS 5,772,900 A * 6/1998 Yorita et al. ..... 210/805

FOREIGN PATENT DOCUMENTS

| | | |
|---|---|---|
| JP | 4-315576 | 11/1992 |
| JP | 9-239661 | 9/1997 |
| JP | 11-19872 | 1/1999 |
| JP | 2000-308967 | 11/2000 |

* cited by examiner

*Primary Examiner*—David A. Reifsnyder
(74) *Attorney, Agent, or Firm*—Sughrue Mion, PLLC

(57) ABSTRACT

An apparatus for recycling a grinding slurry capable of effectively removing unwanted components at a reduced cost. Slurry used in a grinding treatment is at first recovered as recovery slurry. The recovery slurry is then recycled so as to obtain recycled slurry. One or more cyclone separators are provided and used for sizing the used slurry to obtain slurry particles having a predetermined particle size. The slurry having the predetermined particle size is supplied as recovery slurry. When the recovery slurry is recycled to produce recycled slurry, one or more supersonic wave generators are used for irradiating supersonic waves to the recovery slurry.

2 Claims, 3 Drawing Sheets

GRINDING SLURRY RECYCLING APPARATUS

BACKGROUND OF THE INVENTION

The present invention relates to an apparatus for recycling a grinding slurry, particularly to a grinding slurry recycling apparatus which can be used at a time when a chemical machine is being ground.

In the following, description will be given to explain a conventional apparatus for recycling grinding slurry. Usually, an apparatus described below has been commonly employed for recycling slurry used for a process of grinding a chemical machine.

At first, an amount of slurry is supplied to a grinding table of a CMP apparatus. Then, a chemical machine such as a wafer is ground on the grinding table of the CMP apparatus. During the grinding treatment, an amount of slurry dropping from the grinding table of the CMP apparatus is allowed to at first stay in a slurry container. Then, the slurry staying in the slurry container is recovered as used slurry by means of a first pump. Afterwards, the used slurry is caused to pass through a first filter by way of a first valve. The first filter is provided to separate unwanted large particles from the used slurry. Namely, the first filter is a filter element having relatively large mesh eyes. Separated slurry will thus become filtered slurry which arrives at a first tank through a second valve and a third valve, and at the same time arrives at a second tank by way of the second valve and a fourth valve.

Furthermore, a fifth valve and a sixth valve as well as a seventh valve are connected with the second valve. In particular, the seventh valve is connected to both an eighth valve and a ninth valve through a composition analyzer and a second pump. The above eighth valve and the ninth valve are respectively disposed in the open areas of the first and second tanks by means of respective pipes. Further disposed on the open areas of the first and second tanks are a tenth valve and an eleventh valve, respectively. The tenth valve and the eleventh valve are then connected to a second filter through a third pump. In this way, an amount of slurry serving as grinding slurry can be supplied from the second filter to the grinding table of the CMP apparatus.

By properly opening and closing second, third and fourth valves, the filtered slurry is recovered as recovery slurry so as to be moved selectively into the first tank or the second tank. Once the recovery slurry is recovered into the first tank or the second tank, the second valve is closed. Afterwards, the second pump is driven. Upon driving the second pump, the recovery slurry is drawn up from the first tank and the second tank. In this way, the recovery slurry can be again circulated into the above first tank by way of the composition analyzer and the above seventh valve as well as the above third valve. Further, the recovery slurry is also circulated into the second tank by way of the composition analyzer and the above fourth valve. At this time, the fifth valve and the sixth valve are in their opened positions. Subsequently, a fresh slurry and a pure water are supplied to the slurry recycling apparatus through the fifth valve and the sixth valve (the fresh slurry has a higher concentration than the recovery slurry).

In this way, the pure water and the fresh slurry are supplied to the slurry recycling apparatus, while at the same time the concentration of the slurry being circulated is measured by the above composition analyzer. Subsequently, once the concentration of the slurry in circulation becomes equal to a predetermined concentration, the fifth valve and the sixth valve are closed, while the second pump is stopped.

After treating in the above-described manner, the recovery slurry will thus become a recycled slurry having a predetermined concentration. Then, when the recycled slurry is used for performing a grinding treatment, recycled slurry supply valves (the tenth valve and the eleventh valve) for supplying the recycled slurry to the grinding table of the CMP apparatus are opened and the third pump is driven. By virtue of this, the recycled slurry can be drawn up from the first tank and/or the second tank. Subsequently, the recycled slurry is filtered in the second filter, and is supplied as grinding slurry to the grinding table of the CMP apparatus. In fact, the above second filter is provided to separate unwanted small particles failed to be caught up in the above first filter. This means that the above second filter is a filter element having smaller mesh eyes.

In the above slurry recycling apparatus, during wafer grinding treatment, when used slurry is to be recovered and recycled, the used slurry is recovered into either the first tank or the second tank. The recovering, the recycling, and the supplying towards the grinding table carry out in a batch treatment manner.

However, the above conventional apparatus has been found to have the following problem. Namely, since there is a relatively large load on a filter 15 (a front stage filter) which is provided for catching up unwanted large particles such as grinding chips, the front stage filter has only a short life time. In order to solve this problem, although it is allowed to dispose a plurality of filters in several different stages, this will cause an increase in the cost of the filters, thus making the recycling apparatus too expensive. On the other hand, if the front stage filter is replaced by a filter having larger mesh eyes, the life time of the filter 31 (a rear stage filter) will become short.

SUMMARY OF THE INVENTION

The present invention has been suggested in order to eliminate the above-described problems. It is an object of the invention to provide an apparatus for recycling grinding slurry which is used for a chemical machine, making it possible to extend the life time of both the front stage filter and the rear stage filter.

It is another object of the present invention to provide an improved apparatus for recycling a grinding slurry, which is capable of effectively removing unwanted components at a reduced cost.

A grinding slurry recycling apparatus according to the present invention is an apparatus for recovering, as recovery slurry, used slurry used in a grinding treatment, and for recycling the recovery slurry. The recycling slurry is used as the grinding slurry. Specifically, the grinding slurry recycling apparatus of the present invention, comprises a cyclone separator for sizing the particles of the used slurry to obtain sizing slurry particles having a predetermined particle size, and for supplying, as recovery slurry, the sizing slurry having the predetermined particle size. The grinding slurry recycling apparatus further comprises recycling means for recycling the recovery slurry, so as to obtain recycled slurry.

Furthermore, the recycling means includes dispersing means for dispersing the recovery slurry. Moreover, the dispersing means is for example a supersonic wave generator capable of irradiating a supersonic wave to the recovery slurry.

In addition, the recycling means further includes a recycled slurry producing means capable of producing mixed slurry as a recycled slurry by adding and mixing a fresh slurry and a pure water into the sizing slurry. Further, when the concentration of the mixed slurry becomes equal to a predetermined concentration, the mixing of the fresh slurry and the pure water into the recovery slurry is stopped.

Alternatively, the grinding slurry recycling apparatus comprises a first cyclone separator for sizing the particles of the recovery slurry so as to obtain sizing slurry particles having a predetermined particle size. The first cyclone separator supplies, as the recovery slurry, first sizing slurry having the predetermined particle size, and discharges, as discharge slurry, an amount of slurry not containing the first sizing slurry.

The apparatus further comprises supplying means for supplying the discharge slurry, and a second cyclone separator for sizing the particles of the discharge slurry to obtain sizing slurry particles having a predetermined particle size, and for supplying, as the recovery slurry, a second sizing slurry having the predetermined particle size. Moreover, the apparatus includes recycling means capable of recycling the second sizing slurry, so as to obtain recycled slurry which can be used again in the grinding treatment. At this time, it is desired to provide one or more dispersing means (for example, supersonic wave generator) for dispersing the above discharge slurry.

DESCRIPTION OF THE PREFERRED EMBODIMENTS

Figure 1:
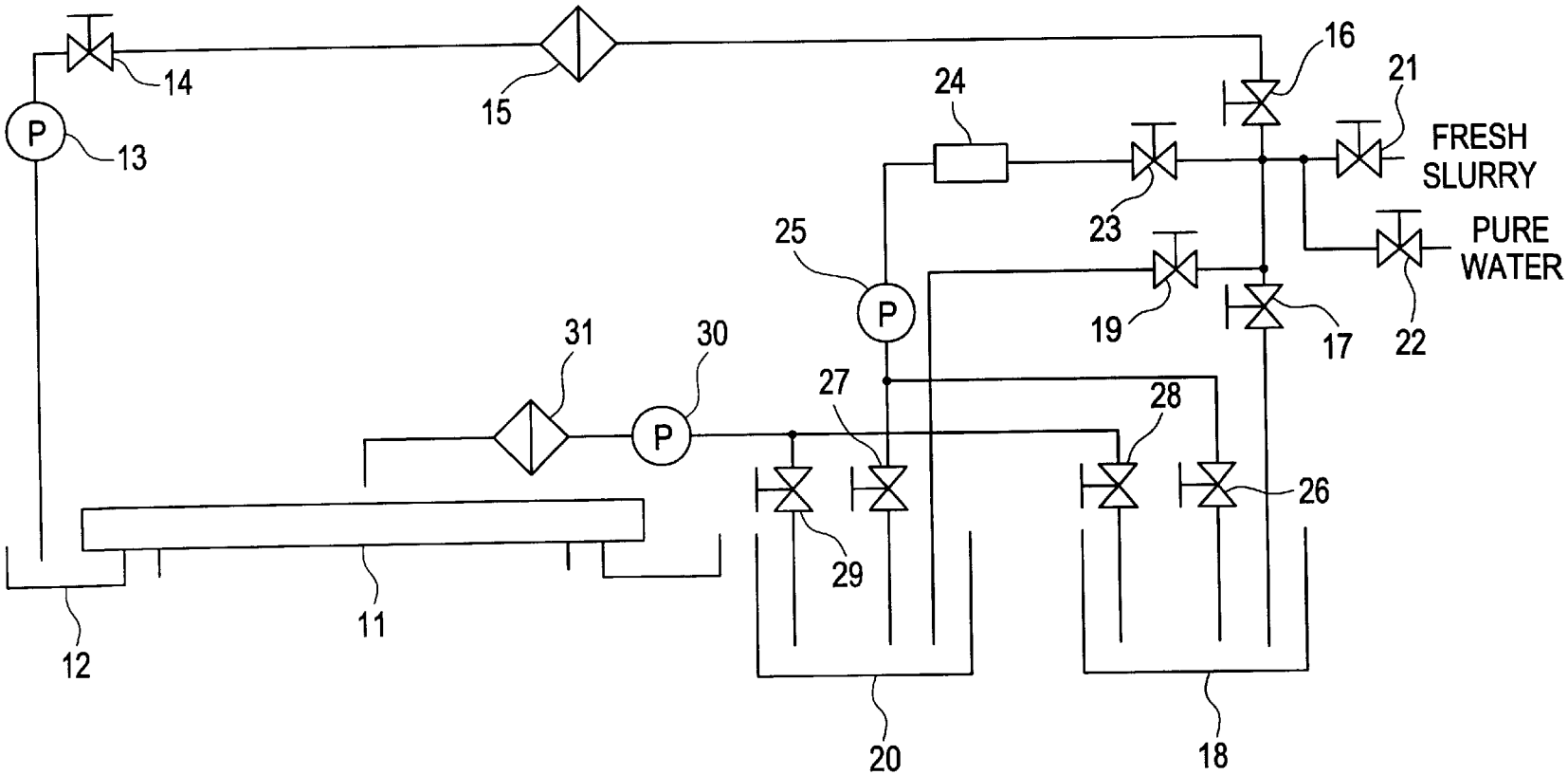
FIG. 1 PRIOR ART
FIG. 1 is an explanatory view schematically showing a conventional apparatus for recycling grinding slurry used for grind chemical machine.

In the following, a conventional apparatus for recycling grinding slurry will be described with reference to FIG. 1. Namely, when slurry used for grinding a chemical machine is to be recycled, a commonly used apparatus is as shown in FIG. 1.

At first, an amount of a slurry is supplied to a grinding table 11 of a CMP apparatus, Then, a chemical machine such as a wafer is ground on the grinding table 11 of the CMP apparatus. During the grinding treatment, an amount of slurry dropping from the grinding table 11 of the CMP apparatus is allowed to at first stay in a slurry container 12. Then, the slurry staying in the slurry container 12 is recovered as used slurry by means of a pump 13. Subsequently, the used slurry is caused to pass through a filter 15 by way of a valve 14. The filter 15 is provided to separate unwanted large particles from the used slurry. Namely, the filter 15 is a filter element having relatively large mesh eyes. Separated slurry will thus become filtered slurry which arrives at a tank 18 through a valve 16 and a valve 17, and at the same arrives at a tank 20 by way of the valve 16 and another valve 19.

Furthermore, the valves 21, 22 and 23 are connected with the valve 16. In particular, the valve 23 is connected to both of the valves 26 and 27 through a composition analyzer 24 and a pump 25. The valves 26 and 27 are respectively disposed in the open areas of tanks 18 and 20 by means of respective pipes. Further disposed on the open areas of the tanks 18 and 20 are valves 28 and 29, respectively. The valves 28 and 29 are then connected to a filter 31 through a pump 30. In this way, an amount of slurry serving as grinding slurry can be supplied from the filter 31 to the grinding table 11 of the CMP apparatus.

By properly opening and closing the valves 16, 17 and 19, the above filtered slurry is recovered as a recovery slurry so as to be moved selectively into the tank 18 or the tank 20. Once the recovery slurry is recovered into the tank 18 or the tank 20, the valve 16 is closed. Afterwards, the pump 25 is driven. Upon driving the pump 25, the recovery slurry is drawn up from the tank 18 and the tank 20. In this way, the recovery slurry can be again circulated into the tank 18 by way of the composition analyzer 24 and the valve 23 as well as the valve 17. Further, the recovery slurry is also circulated into the tank 20 by way of the composition analyzer 24 and the valve 23 as well as the valve 19. At this time, the valve 21 and the valve 22 are in their opened positions. Therefore, a fresh slurry and a pure water may be supplied to the slurry recycling apparatus through the valves 21 and 22 (the fresh slurry has a higher concentration than the recovery slurry).

In this way, the pure water and the fresh slurry are supplied to the slurry recycling apparatus, while at the same time the concentration of the slurry in circulation is measured by the above composition analyzer. Subsequently, once the concentration of the slurry in circulation becomes equal to a predetermined concentration, the valves 21 and 22 are closed, and the pump 25 is stopped.

After treating in the above-described manner, the recovery slurry will thus become recycled slurry having a predetermined concentration. Then, when the recycled slurry is used for performing a grinding treatment, recycled slurry supply valves (the valves 28 and 29) for supplying the recycled slurry to the grinding table of the CMP apparatus are opened and the pump 30 is driven. By virtue of this, the recycled slurry can be drawn up from the tank 18 and/or the tank 20. Subsequently, the recycled slurry is filtered in the filter 31, and is supplied as grinding slurry to the grinding table 11 of the CMP apparatus. In fact, the filter 31 is provided to separate unwanted small particles failed to be caught up in the filter 15. This means that the filter 31 is a filter element having smaller mesh eyes.

During wafer grinding treatment, when a slurry is to be recovered and recycled, a used slurry is recovered into either the tank 18 or the tank 20, with the recovering and recycling as well as its supplying towards the grinding table all carried out in a batch treatment manner.

Figure 2:
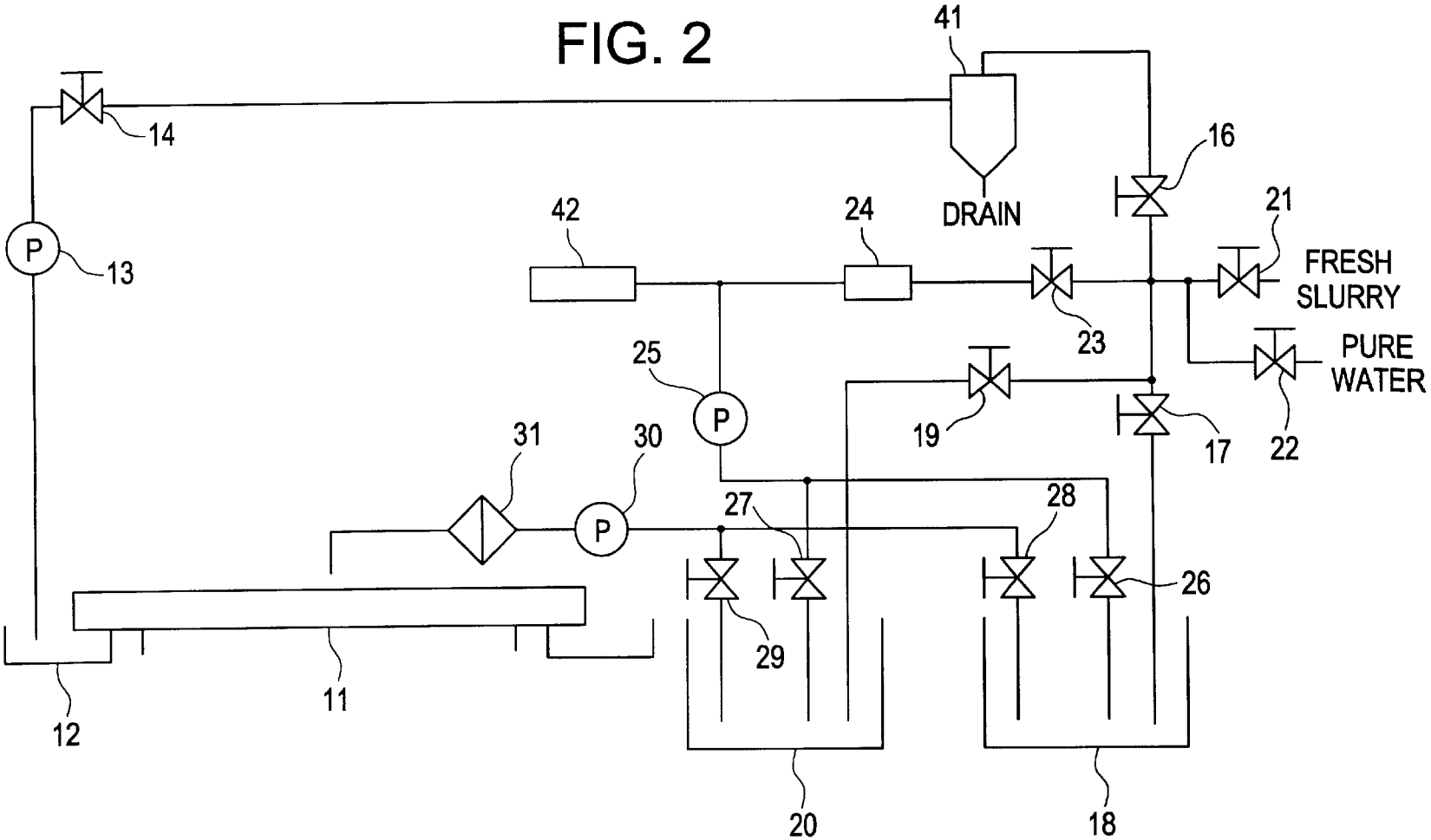
FIG. 2 is an explanatory view schematically showing an improved apparatus for recycling grinding slurry used for grind chemical machine, formed according to one embodiment of the present invention.

Next, referring to FIG. 2, description will be given to one embodiment of an improved apparatus formed according to the present invention for recycling grinding slurry used for a chemical machine. However, in the drawing of FIG. 2, elements identical to those of the recycling apparatus shown in FIG. 1 will be represented by the same reference numerals.

The illustrated apparatus for recycling grinding slurry used for a chemical machine is equipped with a grinding table 11 for grinding a chemical machine such as a wafer. As will be described in the following, slurry is supplied to the grinding table 11 so as to carry out a grinding treatment for grinding a chemical machine. During the grinding treatment, the slurry dropping from the grinding table 11 is allowed to at first stay in the slurry container 12. The slurry accumulated in the slurry container 12 is recovered as used slurry by virtue of a pump 13. The used slurry is then supplied to a cyclone separator 41 by way of a valve 14.

The cyclone separator 41 is connected to a tank 18 through a valve 16 and a valve 17. Further, the cyclone separator 41 is also connected to the tank 20 through the valves 16 and 19. Moreover, the cyclone separator 41 is also connected to a drain. In fact, the used slurry is sized in the cyclone separator 41 so that only particle of a predetermined size are recovered. Subsequently, the used slurry is selectively recovered into the tank 18 or the tank 20 as described later. On the other hand, the slurry particles having other sizes than that predetermined in the cyclone separator 41 are discharged as a waste liquid to the drain, As shown in the drawing, in an area between the valve 16 and the valve 17, the valve 16 is connected with the valves 21, 22 and 23. Specifically, the valve 23 is connected through the composition analyzer 24 to a supersonic wave oscillator 42. A pump 25 is connected between the supersonic oscillator 42 and the composition analyzer 24. The pump 25 is also connected to both the valve 26 and the valve 27. Pipes extending from the valves 26 and 27 are introduced into the tanks 18 and 20.

Valves 28 and 29 are disposed in the vicinity of the tanks 18 and 20. The valves 28 and 29 are also connected to a filter 31 by way of a pump 30. The slurry having passed through the filter 31 is supplied as grinding slurry to the grinding table 11.

By properly opening and closing the valve 16 and the valve 17 as well as the valve 19, the used slurry can be selectively recovered as a recovery slurry into the tank 18 or the tank 20. Once the recovery slurry is recovered into the tank 18 and the tank 20, the valve 16 is closed and then the pump 25 is driven. With the driving of the pump 25, the recovery slurry is drawn up from the tank 18 and the tank 20. The recovery slurry drawn up in this manner is circulated back into the tank 18 through the supersonic wave oscillator 42, the composition analyzer 24 and the valve 17. Meanwhile, the drawn-up recovery slurry is also circulated back into the tank 20 by way of the supersonic wave oscillator 42, the composition analyzer 24 and the valve 19. The recovery slurry in circulation is irradiated by a supersonic wave from the supersonic wave oscillator 42. The slurry irradiated by the supersonic wave is then easily dispersed so that its aggregated state can be desirably broken down. After that, the valve 21 and 22 are opened so that pure water and fresh slurry may be supplied to the recycling apparatus.

In this way, pure water and a fresh slurry may be supplied continuously to the recycling apparatus, while the concentration of the slurry in circulation is measured by the composition analyzer 24. When the concentration of the slurry in circulation becomes equal to a predetermined desired concentration, the valves 21 and 22 are closed. At this time, the pump 25 is stopped.

By treating in the above-described manner, after the recovery slurry has been recycled so that the recycled slurry has been obtained, and when the recycled slurry is used for carrying out a grinding treatment, the valve 28 and/or valve 29 are opened and the pump 30 is driven. By virtue of this, the recycled slurry will be drawn up from the tank 18 and/or the tank 20. The recycled slurry is then filtered by the filter 31 and supplied as grinding slurry to the grinding table 11. The filter 31 is provided to separate unwanted small particles failed to be separated in the cyclone separator 41. Therefore, the filter 31 is a filter element and it is thus required to be formed with many mesh eyes of small size capable of separating unwanted small particles.

In the above-described slurry recycling apparatus, when a wafer is being ground and slurry is being recovered and recycled, the used slurry is recovered into either the tank 18 or the tank 20. Here, the recovering of the slurry and the recycling of the slurry, as well as the supplying of the slurry to the grinding table are all performed in a batch treatment manner.

Next, referring to FIG. 3, a description will be given to another embodiment of an improved apparatus formed according to the present invention for recycling grinding slurry used for a chemical machine. However, in the drawing of FIG. 3, elements identical to those of the recycling apparatus shown in FIG. 2 will be represented by the same reference numerals.

Figure 3:
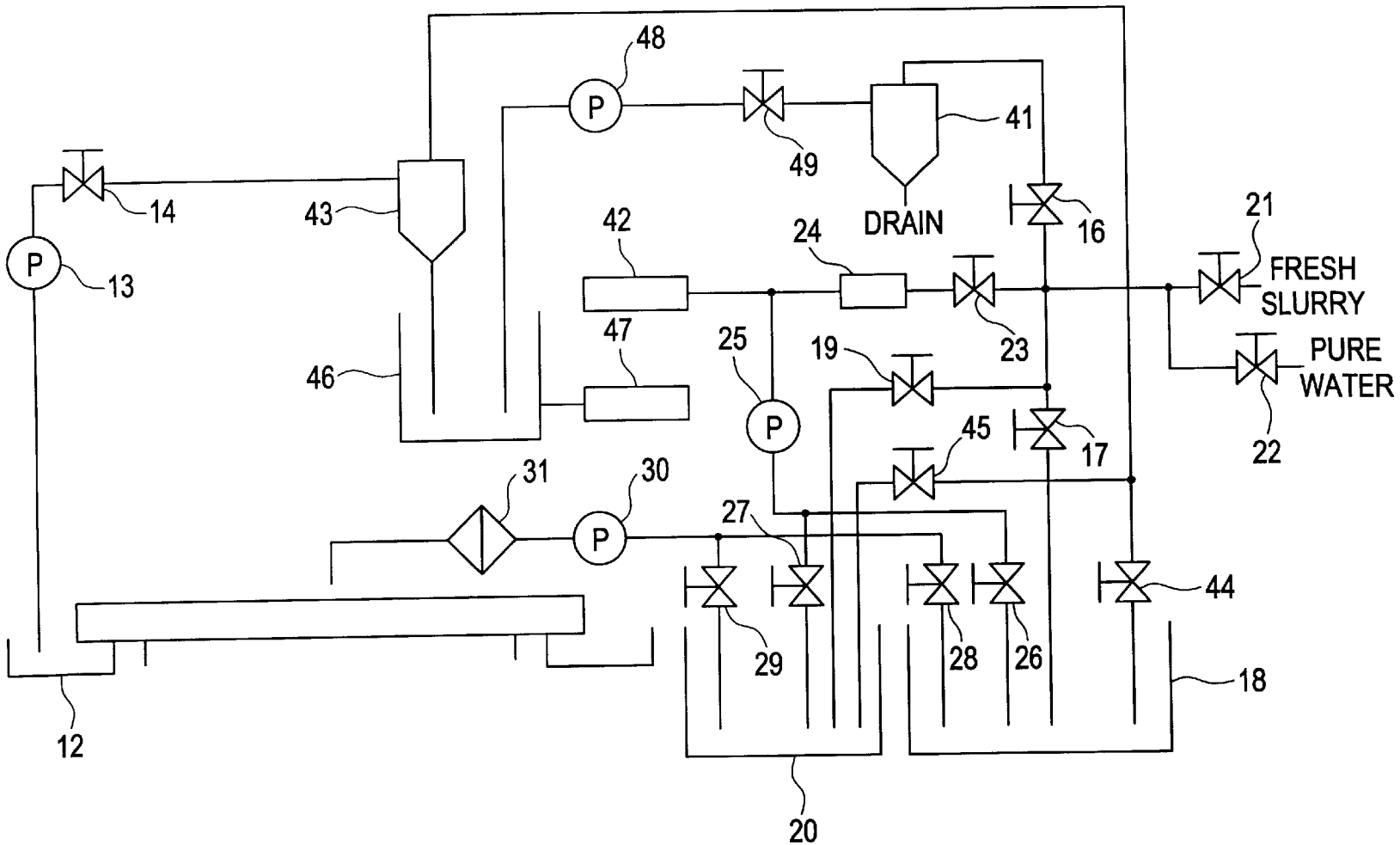
FIG. 3 is also an explanatory view schematically showing an improved apparatus for recycling grinding slurry used for grind chemical machine, formed according to another embodiment of the present invention.

As shown in FIG. 3, an apparatus formed according to the present embodiment for recycling the grinding slurry used for a chemical machine, has a further cyclone separator 43 which is different from the above cyclone separator 41. Here, the cyclone separator 43 is connected with the above cyclone separator 41. Used slurry is supplied to the cyclone separator 43 by way of the valve 14. In fact, the cyclone separator 43 is used for sizing the used slurry so as to obtain certain slurry particles having a predetermined particle size. The slurry particles (having the predetermined particle size) sized by the cyclone separator 43 are then recovered as a recovery slurry into the tank 18 and/or the tank 20 through the valves 44 and 45, respectively. On the other hand, the slurry particles having different particle size from that predetermined in the cyclone separator 43 are at first recovered to a buffer tank 46. At this time, a supersonic wave is irradiated to the slurry staying in the buffer tank 46 from the supersonic wave oscillator 47, The slurry staying in the buffer tank 46 is dispersed thereby.

Subsequently, the slurry staying within the buffer tank 46 is drawn up by virtue of a liquid transporting pump 48. The slurry drawn up in this manner is then supplied through the valve 49 to the cyclone separator 41. At this time, the slurry is again sized in the cyclone separator 41 in the same manner as described with reference to FIG. 2. The sizing slurry particles are then selectively recovered into the tank 18 or the tank 20.

Afterwards, as described with reference to FIG. 2, the recovery slurry staying in the tank 18 and/or the tank 20 can be used as recycled slurry. Therefore, the recycled slurry is thus supplied as grinding slurry to the grinding table 11, by virtue of the pump 30.

As described above, according to the present invention, since one or more than one cyclones are employed to size the particles of used slurry, and since a recycling treatment is carried out after the sizing step, it is possible to reduce the cost associated with the filters. In addition, since the particle size of recycled slurry is in a stabilized condition, it is possible to obtain an extended life time for the filters.

What is claimed is:

1. A grinding slurry recycling apparatus comprising:

a plurality of recovery tanks for recovering as recovery slurry a used slurry used in a grinding treatment;

a cyclone separator for sizing the particles of the recovery slurry so as to obtain sizing slurry having a predetermined particle size, and for supplying, as the recovery slurry, the sizing slurry having the predetermined particle size; and recycling means for recycling the sizing slurry, so as to obtain a recycled slurry which can be used again in the grinding treatment, the recycling means including a supersonic wave generator which irradiates a supersonic wave to the recovery slurry for dispersing the recovery slurry, and wherein the recycling means further comprises:

a recycled slurry producing means for producing mixed slurry as recycled slurry by adding and mixing fresh slurry and pure water into sizing slurry, and wherein when the concentration of the mixed slurry becomes equal to a predetermined concentration, the mixing of the fresh slurry and the pure water into the recovery slurry is stopped.

2. A grinding slurry recycling apparatus comprising:

a plurality of recovery tanks for recovering as recovery slurry a used slurry used in a grinding treatment;

a first cyclone separator for sizing the particles of the recovery slurry so as to obtain sizing slurry particles having a predetermined particle size, and for supplying, as the recovery slurry, first sizing slurry having the predetermined particle size, further for discharging, as discharge slurry, an amount of slurry not containing the first sizing slurry;

supplying means for supplying the discharge slurry;

a second cyclone separator for sizing the particles of the discharge slurry so as to obtain sizing slurry particles having a predetermined particle size, and for supplying, as the recovery slurry, second sizing slurry having the predetermined particle size;

recycling means for recycling the second sizing slurry, so as to obtain a recycled slurry which can be used again in the grinding treatment, the recycling means including a first supersonic wave generator which irradiates supersonic waves to the discharge slurry for dispersing the discharge slurry and a second supersonic wave generator which irradiates supersonic waves to the recovery slurry for dispersing the recovery slurry, and wherein the recycling means further comprises:

a recycled slurry producing means for producing mixed slurry as recycled slurry by adding and mixing fresh slurry and pure water into sizing slurry, and wherein when the concentration of the mixed slurry becomes equal to a predetermined concentration, the mixing of the fresh slurry and the pure water into the recovery slurry is stopped.

* * * * *